US010826196B1

(12) United States Patent
Rogers et al.

(10) Patent No.: US 10,826,196 B1
(45) Date of Patent: Nov. 3, 2020

(54) DIELECTRIC LENS ANTENNA

(71) Applicant: THE BOEING COMPANY, Chicago, IL (US)

(72) Inventors: John E. Rogers, Owens Cross Roads, AL (US); Corey McKinney Thacker, Owens Cross Roads, AL (US)

(73) Assignee: THE BOEING COMPANY, Chicago, IL (US)

( * ) Notice: Subject to any disclaimer, the term of this patent is extended or adjusted under 35 U.S.C. 154(b) by 0 days.

(21) Appl. No.: 16/381,877

(22) Filed: Apr. 11, 2019

(51) Int. Cl.
*H01Q 21/06* (2006.01)
*H01Q 13/00* (2006.01)
(Continued)

(52) U.S. Cl.
CPC ..... *H01Q 21/065* (2013.01); *H01Q 1/48* (2013.01); *H01Q 13/085* (2013.01);
(Continued)

(58) Field of Classification Search
CPC .... H01Q 21/065; H01Q 19/02; H01Q 13/085; H01Q 1/48; H01Q 19/06; H01Q 19/062;
(Continued)

(56) References Cited

U.S. PATENT DOCUMENTS 4,755,820 A * 7/1988 Backhouse ..... H01Q 9/0407 343/700 MS
5,266,963 A 11/1993 Carter et al.
(Continued)

FOREIGN PATENT DOCUMENTS

EP 1249892 A2 10/2002
JP 08125404 A * 5/1996
WO WO-2019032047 A1 * 2/2019 ..... H01Q 9/0428

OTHER PUBLICATIONS

Jehara, K., et al., "Lens-coupled imaging arrays for the millimeter- and submillimeter-wave regions," IEEE Transactions on Microwave Theory and Techniques, vol. 40, No. 5, May 1992, p. 806-811.
(Continued)

*Primary Examiner* — Vibol Tan
(74) *Attorney, Agent, or Firm* — Armstrong Teasdale LLP

(57) ABSTRACT

A radio frequency (RF) antenna including a patch antenna element, a microstrip transmission line, a ground plane, a waveguide, and a dielectric lens. The patch antenna element is disposed on a top surface of a first substrate of the RF antenna, and includes a slot aperture through which the patch antenna element is configured to be electromagnetically coupled to the microstrip transmission line. The microstrip transmission line is disposed between the first substrate and a second substrate. The ground plane is disposed on a third substrate. The microstrip transmission line is configured to be electromagnetically coupled to the ground plane. The waveguide includes a proximal aperture attached to the top surface and enclosing the patch antenna element. The waveguide includes a distal aperture opposite the proximal aperture, and the waveguide is configured to be electromagnetically coupled to the patch antenna element. The dielectric lens is disposed in the distal aperture.

20 Claims, 6 Drawing Sheets

(51) Int. Cl.

| | |
|---|---|
| ***H01Q 1/48*** | (2006.01) |
| ***H01Q 13/08*** | (2006.01) |
| ***H01Q 19/02*** | (2006.01) |
| ***H01Q 19/06*** | (2006.01) |
| ***H01Q 13/10*** | (2006.01) |

(52) U.S. Cl.
CPC ..... *H01Q 13/106* (2013.01); *H01Q 19/02* (2013.01); *H01Q 19/06* (2013.01)

(58) Field of Classification Search
CPC ..... H01Q 13/00; H01Q 13/06; H01Q 13/206; H01Q 13/20; H01Q 13/106
See application file for complete search history.

(56) References Cited

U.S. PATENT DOCUMENTS

| | | | | |
|---|---|---|---|---|
| 5,680,139 | A | 10/1997 | Huguenin et al. | |
| 5,781,163 | A * | 7/1998 | Ricardi | H01Q 15/08 343/754 |
| 5,915,278 | A | 6/1999 | Mallick et al. | |
| 5,966,103 | A * | 10/1999 | Pons | H01Q 25/008 343/753 |
| 6,037,894 | A | 3/2000 | Pfizenmaier et al. | |
| 6,052,087 | A | 4/2000 | Ishikawa et al. | |
| 6,356,246 | B1 * | 3/2002 | Nakamura | H01Q 15/08 343/909 |
| 6,424,318 | B1 * | 7/2002 | Bergstedt | H01Q 15/08 343/911 R |
| 6,590,544 | B1 * | 7/2003 | Filipovic | H01Q 15/08 343/700 MS |
| 6,859,187 | B2 * | 2/2005 | Ohlsson | G01F 23/284 343/772 |
| 7,382,331 | B2 * | 6/2008 | Kurashima | H01Q 9/40 343/700 MS |
| 7,800,549 | B2 | 9/2010 | Rebeiz et al. | |
| 7,825,863 | B2 * | 11/2010 | Martiskainen | H01Q 1/243 343/700 MS |
| 7,994,996 | B2 | 8/2011 | Rebeiz et al. | |
| 8,185,613 | B2 * | 5/2012 | Xie | H04L 63/1408 709/220 |
| 9,590,300 | B2 | 3/2017 | Artemenko et al. | |
| 10,074,890 | B2 * | 9/2018 | Barnickel | H01Q 21/0068 |
| 10,361,476 | B2 * | 7/2019 | Ou | H01Q 21/065 |
| 2005/0219126 | A1 | 10/2005 | Rebeiz et al. | |

OTHER PUBLICATIONS

Raman, S., et al., "A W-band dielectric-lens-based integrated monopulse radar receiver," IEEE Transactions on Microwave Theory and Techniques, vol. 46, No. 12, Dec. 1998, p. 2308-2316.

Wu, X., et al., "Design and characterization of single- and multiple-beam mm-wave circularly polarized substrate lens antennas for wireless communications," IEEE Transactions on Microwave Theory and Techniques, vol. 49, No. 3, Mar. 2001, p. 431-441.

Mall, L. et al., "Millimeter-wave proximity-coupled microstrip antenna on an extended hemispherical dielectric lens," IEEE Transactions on Antennas and Propagation, vol. 49, No. 12, Dec. 2001, p. 1769-1772.

Schoenlinner, B., et al., "Wide-scan spherical-lens antennas for automotive radars," IEEE Transactions on Microwave Theory and Techniques, vol. 50, No. 9, Sep. 2002, p. 2166-2175.

Zhang, . et al. "A millimeter-wave gain enhanced multi-beam antenna based on a coplanar cylindrical dielectric lens." IEEE Transactions on Antennas and Propagation 60, No. 7 (2012): 3485-3488.

Liang, M. et al. "A 3-D Luneburg lens antenna fabricated by polymer jetting rapid prototyping." IEEE Transactions on Antennas and Propagation 62, No. 4 (2014): 1799-1807.

Yi, J. et al. "Restoring in-phase emissions from non-planar radiating elements using a transformation optics based lens." Applied Physics Letters 107, No. 2 (2015): 024101.

* cited by examiner

DIELECTRIC LENS ANTENNA

FIELD

The field of the disclosure relates generally to radio and microwave frequency systems and, more specifically, to a dielectric lens antenna.

BACKGROUND

Many known radar applications utilize "steerable," or directed, beams. Such steering is often accomplished with an active electronically steerable antenna (AESA) or, alternatively, with a mechanically scanned antenna, i.e., an antenna array that is physically steered. Such antennas are commonly installed on air, land, and sea vehicles, as well as on fixed land installations. Similar antennas may also be utilized in certain radio frequency (RF) or microwave frequency communication systems. Mechanically-scanned and electronically steerable alternatives are often too large, too expensive, and consume too-much power for certain applications. For many applications, particularly in aircraft, it is desirable to have low-cost, low-power, and low-size and low-weight steerable antenna arrays.

BRIEF DESCRIPTION

One aspect of the present disclosure includes an RF antenna. The RF antenna includes a patch antenna element, a microstrip transmission line, a ground plane, a waveguide, and a dielectric lens. The patch antenna element is disposed on a top surface of a first substrate of the RF antenna, and includes a slot aperture through which the patch antenna element is configured to be electromagnetically coupled to the microstrip transmission line. The microstrip transmission line is disposed between the first substrate and a second substrate. The ground plane is disposed on a third substrate. The microstrip transmission line is configured to be electromagnetically coupled to the ground plane. The waveguide includes a proximal aperture attached to the top surface and enclosing the patch antenna element. The waveguide includes a distal aperture opposite the proximal aperture, and the waveguide is configured to be electromagnetically coupled to the patch antenna element. The dielectric lens is disposed in the distal aperture.

Another aspect of the present disclosure includes a method of fabricating an RF antenna. The method includes disposing a patch antenna element on a first dielectric layer, disposing a microstrip transmission line on a second dielectric layer, and disposing a ground plane on a third dielectric layer. The patch antenna element includes a slot aperture. The method includes laminating at least the first dielectric layer, the second dielectric layer, and the third dielectric layer into a board assembly such that the microstrip transmission line is configured to be electromagnetically coupled to the ground plane and electromagnetically coupled to the patch antenna element through the slot aperture. The method includes attaching a proximal aperture of a waveguide to a top surface of the first dielectric layer and enclosing the patch antenna element. The waveguide is configured to be electromagnetically coupled to the patch antenna element. The method includes disposing a dielectric lens in a distal aperture of the waveguide.

The features, functions, and advantages that have been discussed can be achieved independently in various embodiments or may be combined in yet other embodiments further details of which can be seen with reference to the following description and drawings.

DETAILED DESCRIPTION

Embodiments of the systems described herein include an RF antenna and, more specifically, a dielectric lens antenna. The RF antenna includes an RF printed circuit board (PCB), or board assembly, having a ground plane, a microstrip transmission line, and a patch antenna element. The patch antenna element is disposed on a top surface of the RF antenna and includes a slot aperture through which the patch antenna element is electromagnetically coupled to the microstrip transmission line. The slot aperture decreases the axial ratio of the antenna, resulting in reduced polarization loss. The microstrip transmission line is positioned, or embedded, in a layer between the ground plane and the patch antenna element. The ground plane reduces the effects of conductive environmental surfaces to which the RF antenna may be coupled, connected, or otherwise attached. In certain embodiments, a coupling element, or "tuning element," is positioned on another layer between the microstrip transmission line and the patch antenna element. The RF antenna includes a waveguide having a proximal aperture attached to the top surface of the RF antenna and encloses the patch antenna element, and a distal aperture opposite the proximal. The RF antenna includes a dielectric lens disposed in the distal aperture of the waveguide. The dielectric lens improves the radiation performance of the antenna. The RF antennas described herein may be fabricated, in certain embodiments, for example, by additive manufacturing methods, such as printing, or by subtractive methods, such as wet etching.

Figure 1:
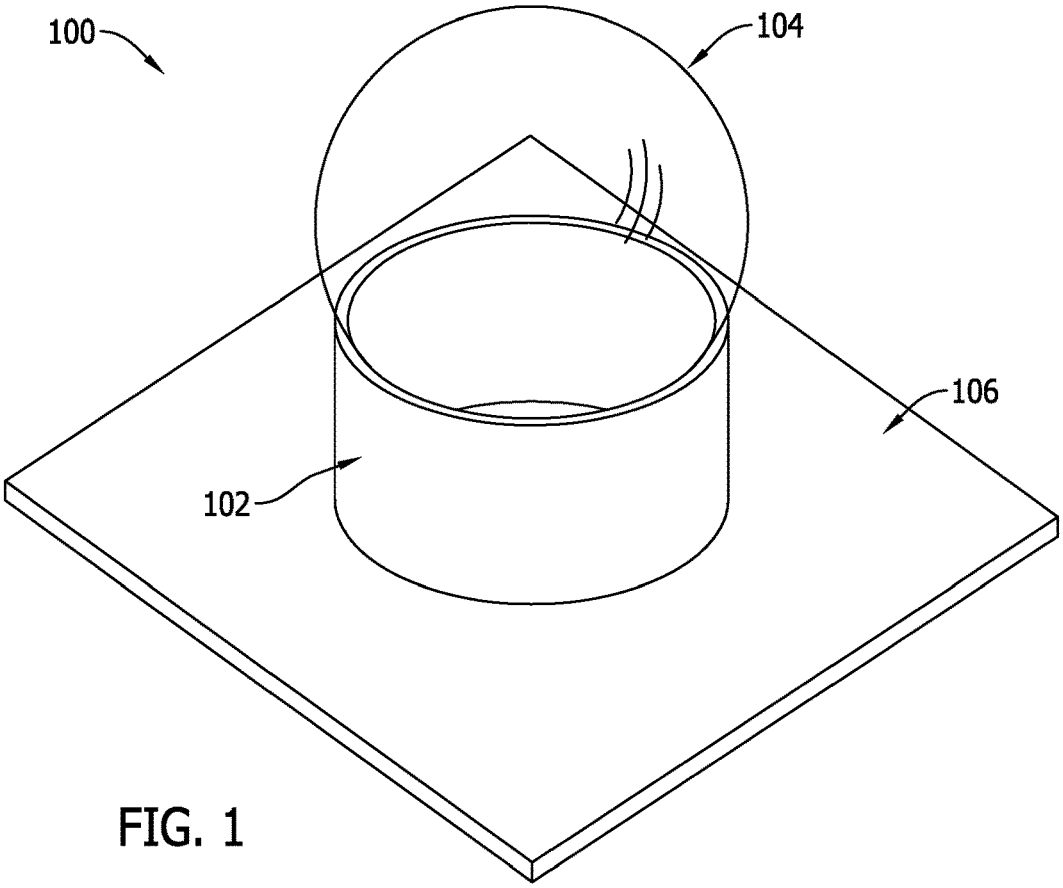
FIG. 1 is a perspective schematic diagram of an example RF antenna embodiment.
Figure 2:
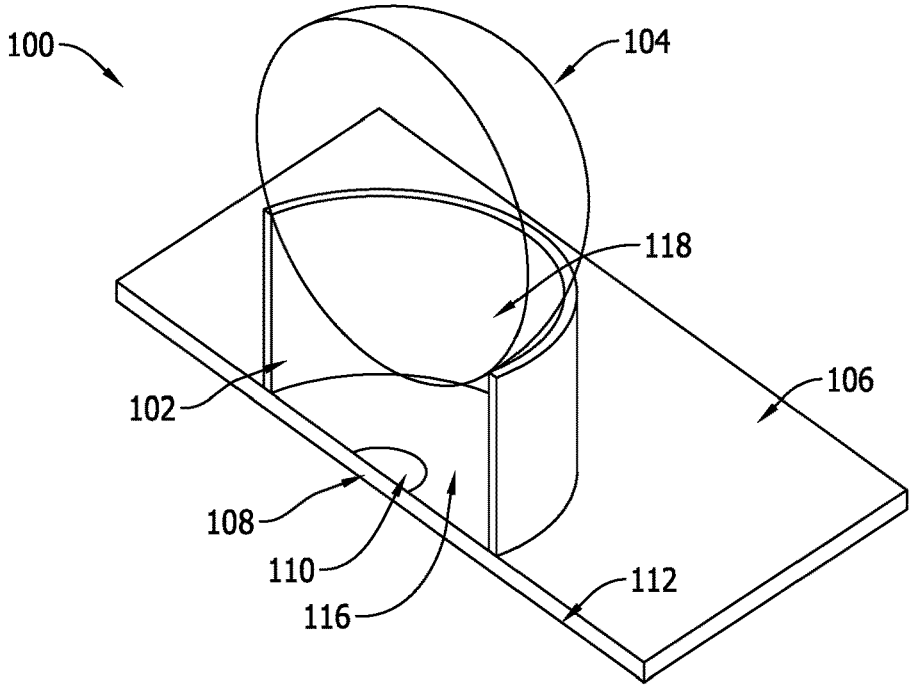
FIG. 2 is a perspective cross-section schematic diagram of the RF antenna shown in FIG. 1.
Figure 3:
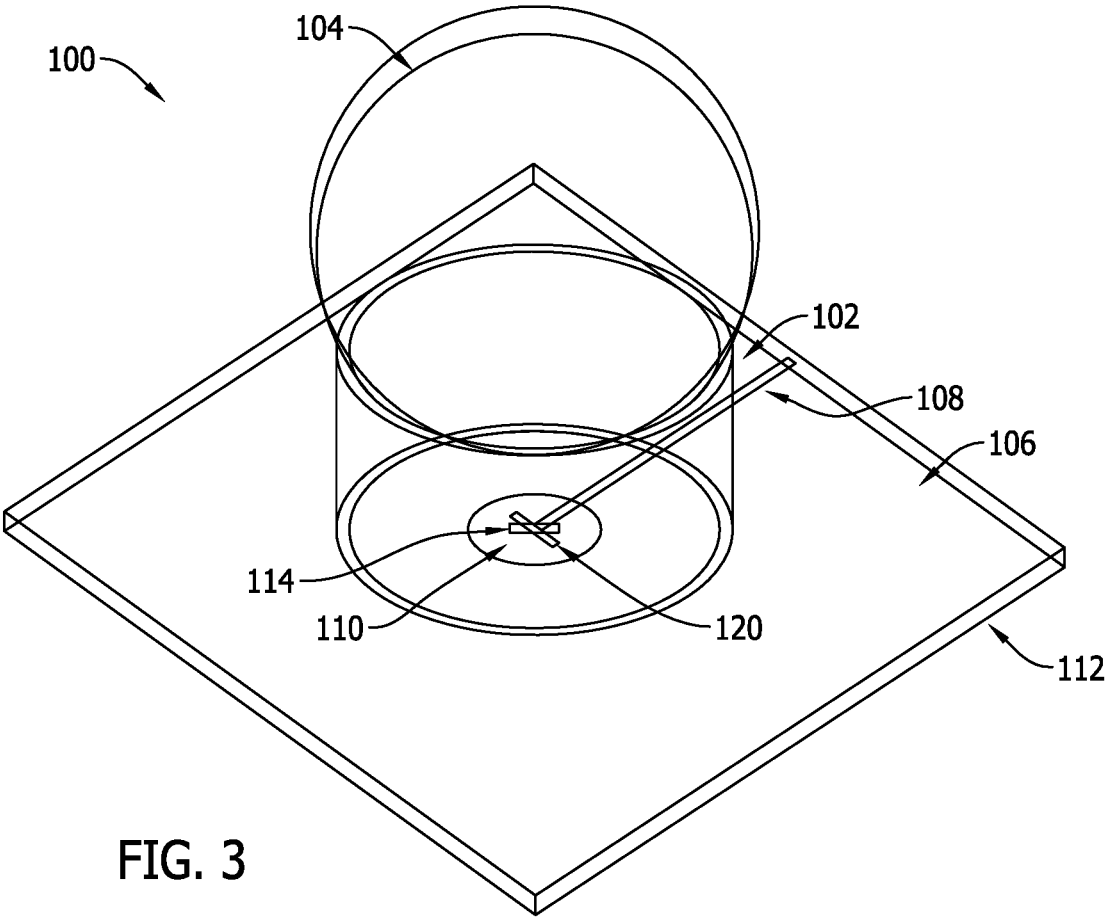
FIG. 3 is another perspective schematic diagram of the RF antenna shown in FIG. 1.

FIG. 1 is a perspective schematic diagram of an example RF antenna 100 with a circular waveguide 102 and a dielectric lens 104. RF antenna 100 includes a board assembly 106. FIG. 2 is a perspective cross-section schematic diagram of RF antenna 100 shown in FIG. 1. FIG. 3 is another perspective schematic diagram of RF antenna 100 shown in FIG. 1 with certain components illustrated as partially transparent to reveal additional components. Likewise, FIG. 4 is another perspective cross-section schematic diagram of RF antenna 100 with those same components illustrated as partially transparent.

RF antenna 100 and, more specifically, board assembly 106 includes a microstrip transmission line 108, a patch antenna element 110, and a ground plane 112. Patch antenna element 110 includes a slot aperture 114 through which patch antenna element 110 may be electromagnetically coupled to microstrip transmission line 108, which feeds patch antenna element 110. A signal radiated by patch antenna element 110 electromagnetically couples into waveguide 102, through which it propagates from a proximal aperture 116 toward a distal aperture 118. Dielectric lens 104 is disposed in distal aperture 118 of waveguide 102. Dielectric lens 104 improves the radiation performance from distal aperture 118 of waveguide 102. Additionally, the microstrip-to-waveguide transition formed between microstrip transmission line 108 and waveguide 102 is simple and avoids the size, weight, and cost of coaxial adapters. Moreover, in certain embodiments, patch antenna element 110 may be combined with slot aperture 114 and a dielectric lens (not shown) disposed on patch antenna element 110, which results in good insertion loss and good return loss performance for a given desired operating frequency. In certain embodiments, RF antenna 100 includes a coupling element 120, which improves the electromagnetic coupling of signals from microstrip transmission line 108 to patch antenna element 110. Generally, coupling element 120 is embedded in a layer of board assembly 106 between microstrip transmission line 108 and patch antenna element 110, and has dimensions and orientation to enhance electromagnetic coupling from microstrip transmission line 108 to waveguide 102. For example, coupling element 120 is a linear conductive element oriented orthogonal to microstrip transmission line 108 and at about a 45 degree angle with respect to slot aperture 114. The length and width of coupling element 120 are selected according to the desired operating frequency and impedance of microstrip transmission line 108 and patch antenna element 110.

Waveguide 102 has a shape and dimensions that define the range of signals (e.g., frequency and mode) that will propagate through waveguide 102. Waveguide 102, for example, may include a circular or rectangular waveguide, or any other shape of waveguide. Generally, although the antenna is referred to as an RF antenna, waveguide 102 is dimensioned for microwave signals, or signals having a frequency between about 300 Megahertz (MHz) and about 300 Gigahertz (GHz). Accordingly, RF antenna 100 may also be referred to as a dielectric lens antenna or a microwave antenna. For example, in one embodiment, waveguide 102 is dimensioned for an operating frequency of 20 GHz. Likewise, microstrip transmission line 108, patch antenna element 110, slot aperture 114, and the size and shape of dielectric lens 104 are designed for efficient signal propagation at the desired operating frequency, and are further designed for impedance matching at, for example, the transition from microstrip transmission line 108 to dielectric lens 104. Further, the size and shape of dielectric lens 104 are selected to produce a desired radiation pattern, or emission pattern. Generally, slot aperture 114 has a length and width corresponding to the desired operating frequency, and patch antenna element 110 has a diameter corresponding to the desired operating frequency. The orientation of slot aperture 114 is selected for efficient signal propagation for the desired operating frequency. Generally, microstrip transmission line 108 has a width corresponding to an impedance suitable for the operating frequency and for transitioning to patch antenna element 110. Generally, dielectric lens 104 has a shape corresponding to the shape of waveguide 102. For example, dielectric lens 104 shown in FIG. 1 is a spherical body of dielectric material, or spherical in shape, and extends partially into waveguide 102 up to, for example, within a quarter-wavelength of patch antenna element 110 at the nadir of dielectric lens 104. The distance dielectric lens 104 extends into waveguide 102 and, consequently, its range to patch antenna element 110, may vary according to the desired operating frequency for RF antenna 100 and for the purpose of impedance matching, for example. Moreover, the radius of dielectric lens 104 is selected to impedance-match waveguide 102 and an operating frequency of waveguide 102, and improve a gain of RF antenna 100.

Figure 4:
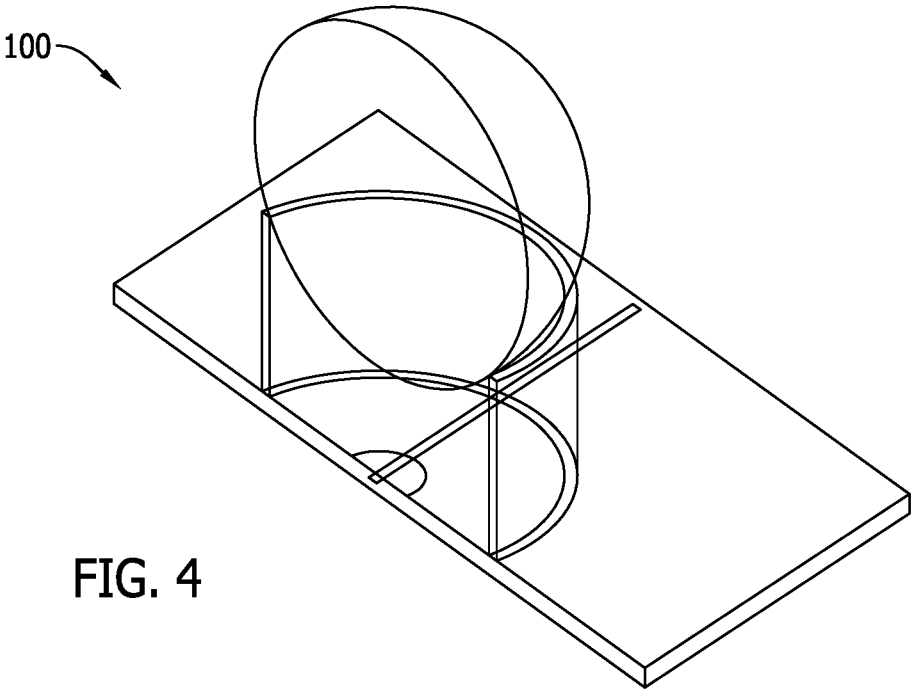
FIG. 4 is another perspective cross-section schematic diagram of the RF antenna shown in FIG. 3 with a dielectric lens.

As shown in FIGS. 3 and 4, patch antenna element 110 includes a circular patch, waveguide 102 includes a circular waveguide, and dielectric lens 104 includes a spherical dielectric lens. The circular patch results in current densities having circular rotation that further produces circular polarization that is suitable for transmission into a circular waveguide. Alternatively, in certain embodiments, patch antenna element 110 may be a rectangular patch, waveguide 102 may be a rectangular waveguide, and dielectric lens 104 may have a pyramid shape. The corresponding shapes and dimensions of patch antenna element 110, waveguide 102, and dielectric lens 104 results in current densities suitable for propagating through a rectangular waveguide.

Figure 5:
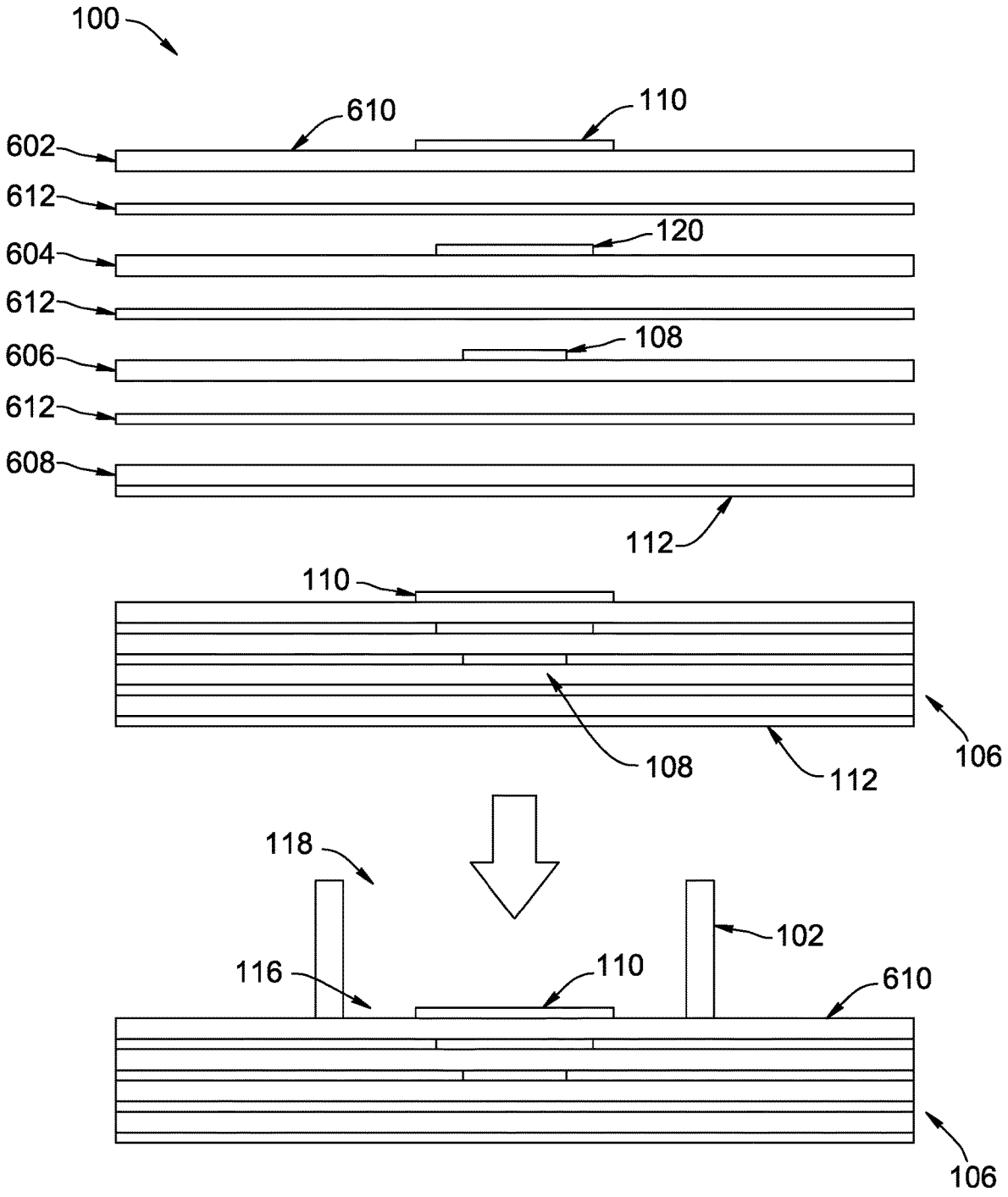
FIG. 5 is a cross-section schematic diagram of an example board assembly for the RF antenna shown in FIG. 1.
Figure 6:
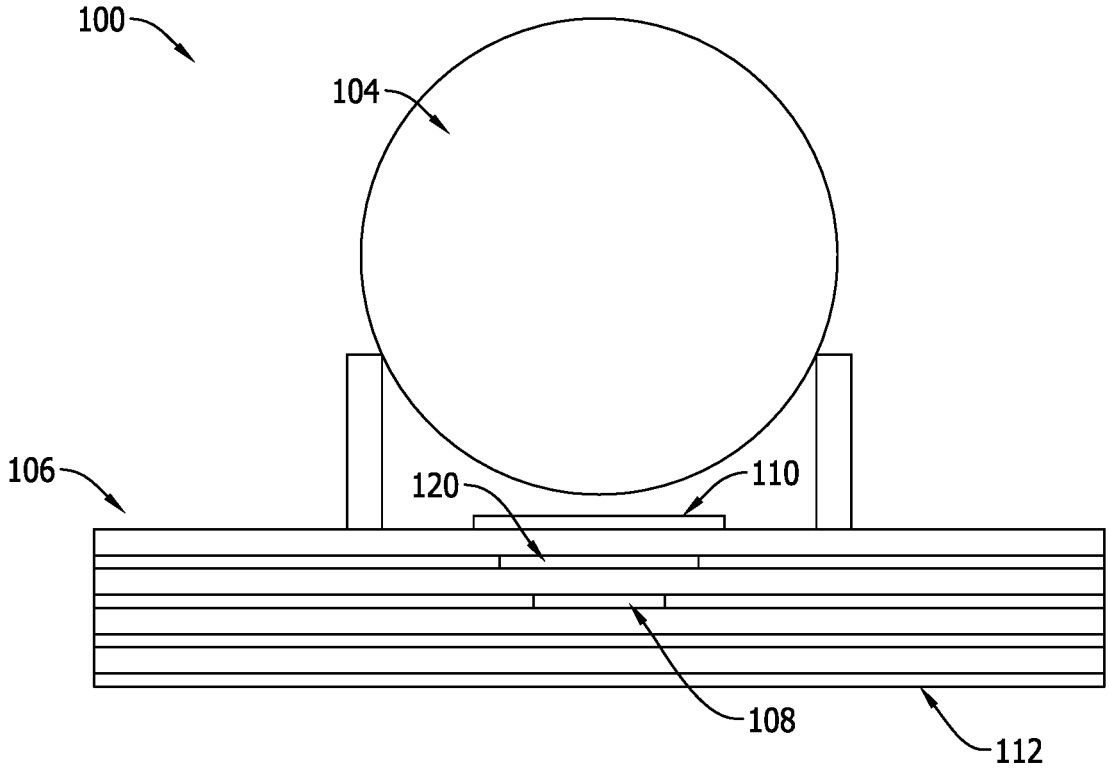
FIG. 6 is a cross-section schematic diagram of the RF antenna shown in FIG. 5.

FIG. 5 is a cross-section schematic diagram of board assembly 106 for RF antenna 100 shown in FIGS. 1-4. FIG. 6 is a cross-section schematic diagram of RF antenna 100 shown in FIG. 5. FIG. 5 includes various layers of board assembly 106, including dielectric layers, or substrates, conductors, and adhesive films for laminating board assembly 106. Each layer may be fabricated using subtractive methods, such as laser etching, milling, or wet etching, additive methods, such as printing or film deposition, or a combination of both. Board assembly 106 includes a first substrate 602, a second substrate 604, a third substrate 606, and a fourth substrate 608. Patch antenna element 110 is disposed on a top surface 610 of first substrate 602. Coupling element 120 is disposed on second substrate 604. Microstrip transmission line 108 is disposed on third substrate 606. Ground plane 112 is disposed on fourth substrate 608.

First, second, third, and fourth substrates 602, 604, 606, and 608 are laminated, or bonded, together using, for example, adhesive films 612 disposed between each layer. Microstrip transmission line 108 is embedded in board assembly 106 between ground plane 112 and patch antenna element 110, and more specifically, between third substrate 606 and second substrate 604. Similarly, coupling element 120 is embedded in board assembly 106 between microstrip transmission line 108 and patch antenna element 110, and more specifically, between first substrate 602 and second substrate 604. In certain embodiments, RF antenna 100 may may omit coupling element 120 and may include no other conductive layers between microstrip transmission line 108 and patch antenna element 110 (i.e., between first substrate 602 and second substrate 604). Accordingly, in such embodiments, first substrate 602 and second substrate 604 may be referred to as a single combined substrate having multiple dielectric layers. In alternative embodiments, second substrate 604 and coupling element 120 are both omitted, and first substrate 602 is bonded directly to third substrate 606 using adhesive film 612.

RF antenna 100 includes waveguide 102 having a proximal aperture 116 and a distal aperture 118. Proximal aperture 116 of waveguide 102 is attached to top surface 610 and encloses patch antenna element 110, such that a signal radiating from patch antenna element 110 electromagnetically couples into waveguide 102 and propagates through waveguide 102 toward distal aperture 118. As illustrated in FIG. 6, dielectric lens 104 is disposed in distal aperture 118 of waveguide 102. Dielectric lens 104, like the dielectric layers and conductive layers of board assembly 106, may be deposited using additive methods, such as, for example, using a printing process, such that it would extend both into distal aperture 118 of waveguide 102 toward top surface 610 and out from distal aperture 118. Dielectric lens 104 improves the radiation performance of RF antenna 100.

Figure 7:
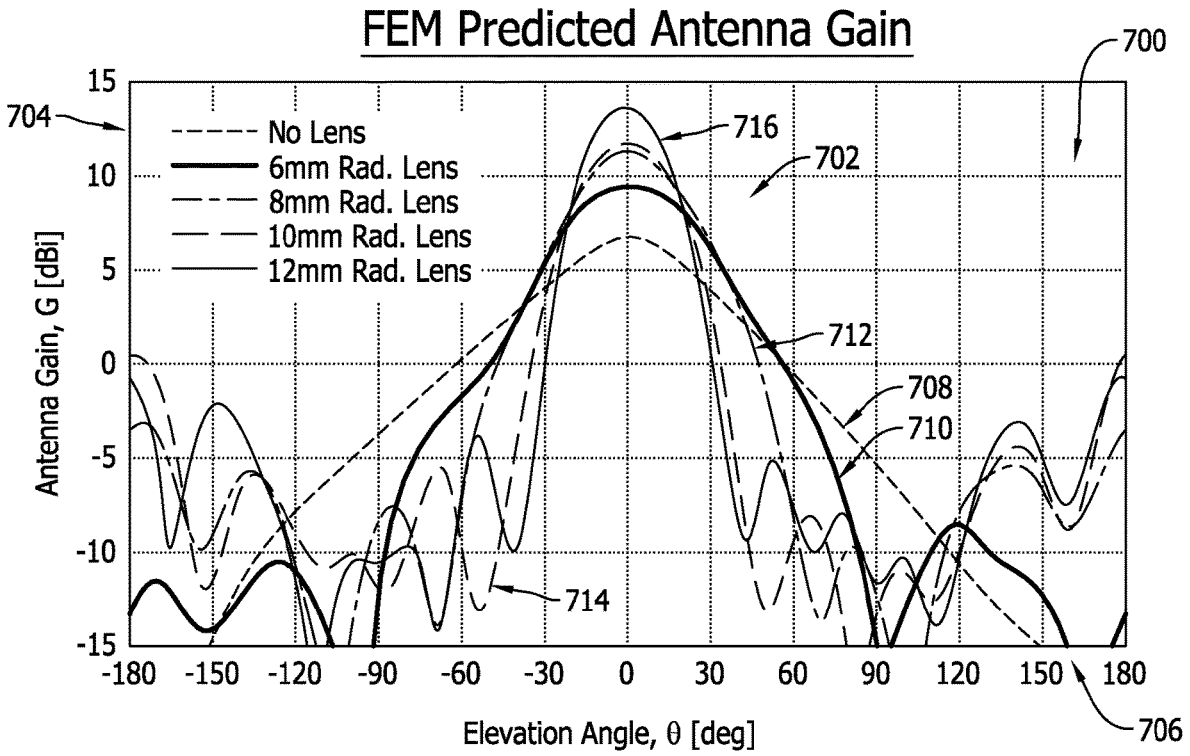
FIG. 7 is an example graph illustrating antenna gain versus elevation angle for the RF antenna shown in FIG. 1.

FIG. 7 is an example graph 700 of antenna gain versus elevation angle for RF antenna 100 shown in FIG. 1. Graph 700 includes antenna gain plots 702, a vertical axis 704 for antenna gain expressed in decibels-isotropic (dBi), and a horizontal axis 706 for elevation angle expressed in degrees. Generally, antenna gain, or simply "gain," is a measure of the directivity and electrical efficiency of an antenna, such as RF antenna 100. Antenna gain plot 702 is illustrated versus elevation angle and, thus, further represents a radiation pattern of RF antenna 100. For the spherically shaped dielectric lens 104, an elevation (theta) of zero degrees represents the direction through waveguide 102 and orthogonal to the plane defined by patch antenna element 110. The elevation angle then increases in value (e.g., positive or negative) as the direction of radiation deviates from zero degrees elevation. Antenna gain plots 702 includes individual plots for various different dimensioned (i.e., different radius) dielectric lenses, including a control plot 708 illustrating antenna gain without dielectric lens 104, antenna gain 710 for a 6 millimeter (mm) radius dielectric lens, antenna gain 712 for an 8 mm radius dielectric lens, antenna gain 714 for a 10 mm radius dielectric lens, and antenna gain 716 for a 12 mm radius dielectric lens. As illustrated by plots 702, each instance of dielectric lens 104 improved the radiation performance of RF antenna 100 with respect to antenna gain. Notably, for example, antenna gain 716 illustrates a 12 mm radius dielectric lens yields the largest improvement in radiation performance over a like-antenna having no dielectric lens, i.e., where dielectric lens 104 is omitted.

Figure 8:
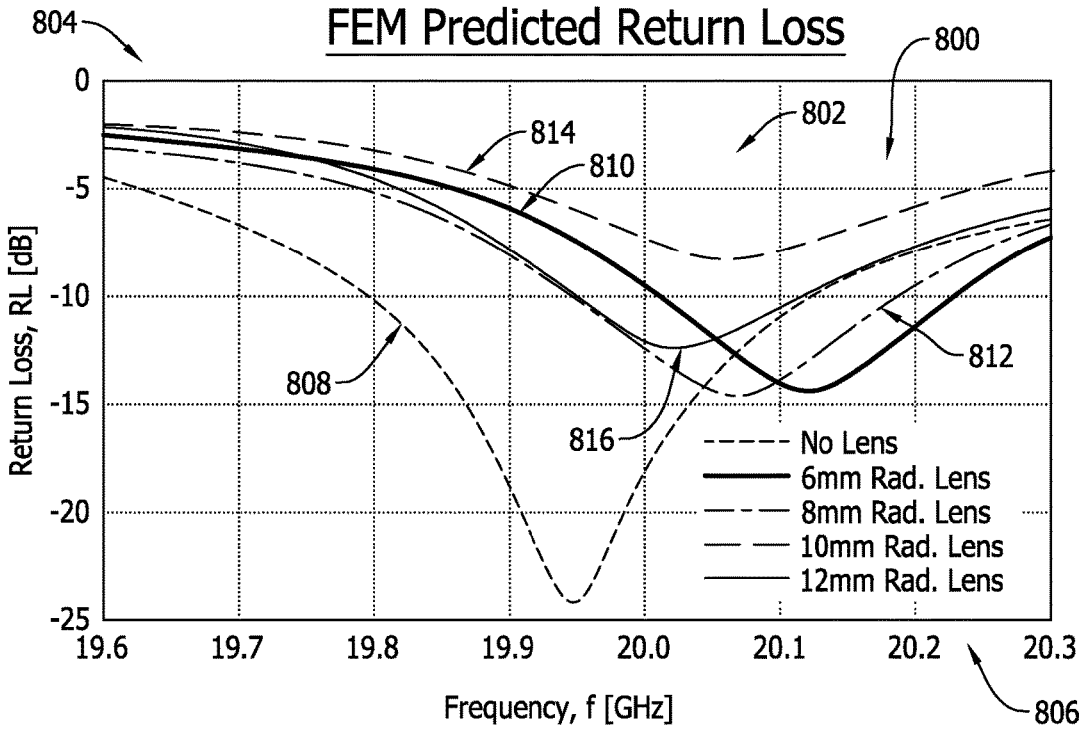
FIG. 8 is an example graph illustrating return loss versus frequency for the RF antenna shown in FIG. 1.

FIG. 8 is an example graph 800 of return loss versus frequency for RF antenna 100 shown in FIG. 1. Graph 800 includes return loss, RL, plots 802, a vertical axis 804 for return loss expressed in decibels (dB), and a horizontal axis 806 for frequency expressed in GHz. Generally, return loss, RL, is a performance measure of the power reflected in a device, such as, e.g., a waveguide. Here, return loss is a measure of reflections occurring at the transition from waveguide 102 to dielectric lens 104 of RF antenna 100, and may, in certain embodiments, be expressed in dB and generally defined as $10 \log_{10} P_{ref}/P_i$, where $P_{ref}$ is reflected power and $P_i$ is incident power. More specifically, incident power is power transmitted over the feeding microstrip transmission line 108 to patch antenna element 110 and into waveguide 102, and reflected power is power reflected by any discontinuity created by dielectric lens 104 at distal aperture 118 of waveguide 102 back toward patch antenna element 110 and microstrip transmission line 108. Generally, when reflections are low, which is preferred, return loss is large and negative. As in graph 700, return loss plots 802 includes individual plots for the various different dimensioned (i.e., different radius) dielectric lenses, including a control plot 808 illustrating return loss without dielectric lens 104, return loss 810 for a 6 millimeter (mm) radius dielectric lens, return loss 812 for an 8 mm radius dielectric lens, return loss 814 for a 10 mm radius dielectric lens, and return loss 816 for a 12 mm radius dielectric lens.

Control plot 808 illustrates performance of RF antenna 100 with respect to return loss is about −24 dB around an operating frequency of about 19.95 GHz without dielectric lens 104. When dielectric lens 104 is introduced, some amount of return loss is also introduced and, consequently, the frequency at which peak return loss performance occurs shifts. Notably among return loss plots 802, return loss 816 for a 12 mm radius dielectric lens yields a peak return loss of about −12 dB, although the same dielectric lens produces the greatest improvement (among the various dielectric lenses tested) in antenna gain, as illustrated in graph 700. Further, return loss 810 for the 6 mm radius dielectric lens and return loss 812 for the 8 mm radius dielectric lens yield the best performance in return loss at about −14 dB.

Figure 9:
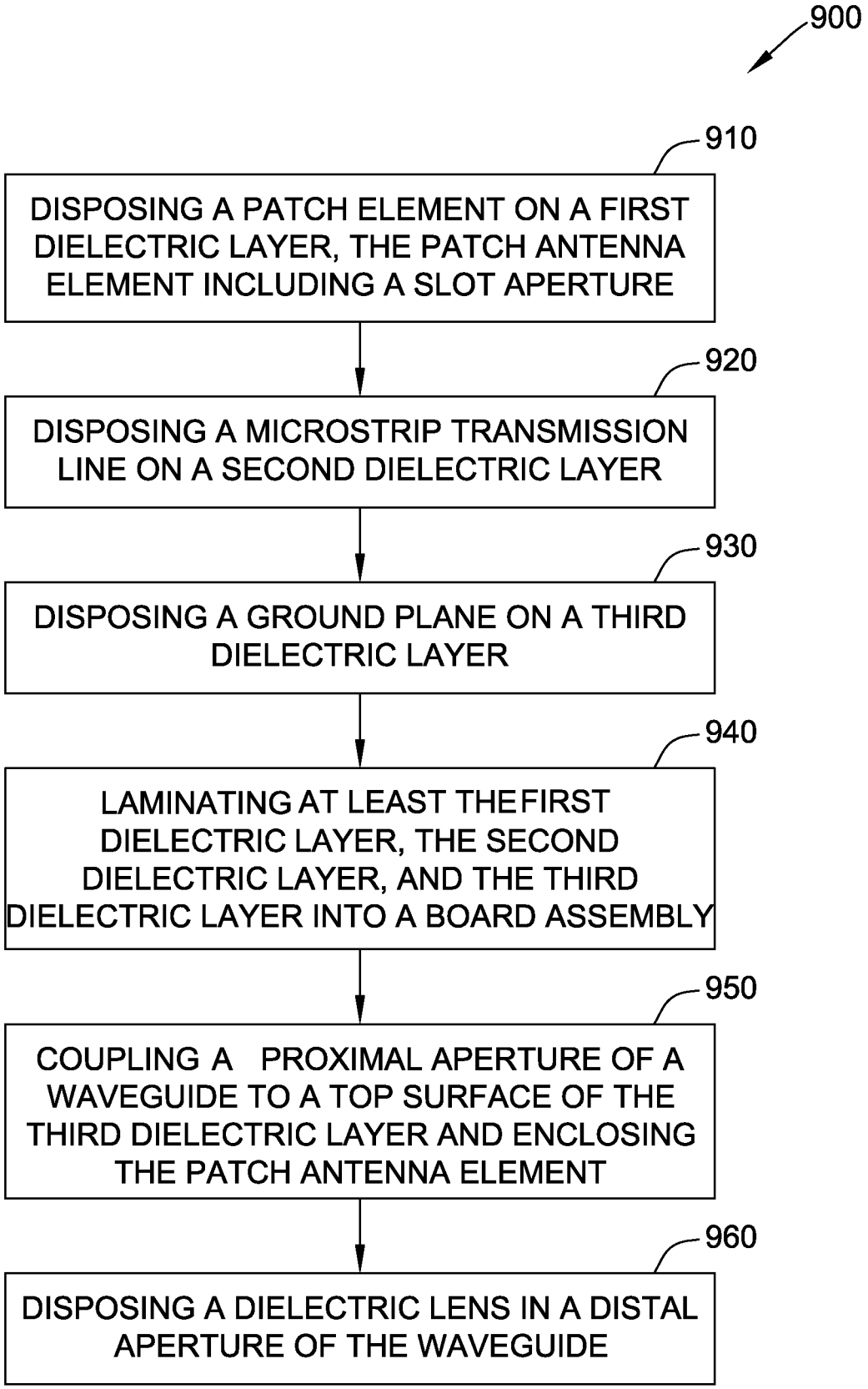
FIG. 9 is a flow diagram of an embodiment of an example method of fabricating an RF antenna, such as that shown in FIG. 1.

FIG. 9 is a flow diagram of an embodiment of an example method of fabricating an RF antenna, such as RF antenna 100 shown in FIGS. 1 and 6. Method 900 includes disposing 910 patch antenna element 110 on top surface 610 of a first dielectric layer, such as first substrate 602. The formation of patch antenna element 110 includes forming slot aperture 114 in the conductive material. Microstrip transmission line 108 likewise is disposed 920 on a second dielectric layer, such as third substrate 606, and ground plane 112 is disposed 930 on a third dielectric layer, such as fourth substrate 608. Each of the conductive layers, i.e., ground plane 112, microstrip transmission line 108, and patch antenna element 110, may be formed by subtractive methods, such as laser etching, milling, or wet etching, additive methods, such as printing or film deposition, or a combination of both. For example, disposing 920 microstrip transmission line 108 may include depositing a layer of conductive material onto the second dielectric layer, or third substrate 606, and etching the conductive material to form microstrip transmission line 108 to a width corresponding to a desired impedance value.

Conductive layers are generally formed from an electrically conductive material, such as copper or any other electrically conductive material suitable for use in RF circuit boards. In certain embodiments, disposing 920 microstrip transmission line includes depositing a conductive material onto the second dielectric layer, using a printing process, such that microstrip transmission line 108 has a width corresponding to a desired impedance value. Likewise, in certain embodiments, disposing 910 patch antenna element 110 includes depositing a conductive material onto the first dielectric layer, using a printing process, such that slot aperture 114 includes a length, a width, and an angular orientation corresponding to an operating frequency of RF antenna 100 and, for example, waveguide 102, and such that the patch antenna element has a geometry corresponding to a geometry of the aperture of waveguide 102.

In alternative embodiments, disposing 920 microstrip transmission line 108 includes depositing a layer of a conductive material onto the second dielectric layer, e.g., on third substrate 606. The conductive material is then etched to form microstrip transmission line 108 having a width corresponding to a desired impedance value.

In certain embodiments, coupling element 120, or a tuning element, is disposed on fourth dielectric layer disposed between the first and second dielectric layers, e.g., between first substrates 602 and third substrate 606. Substrates 602, 604, 606, and 608 are formed from a dielectric material such as silicon, gallium arsenide, indium phosphide, polytetrafluoroethylene (PTFE) or other polymer, or any other suitable dielectric material. Generally, selections of a dielectric material and its thickness are made based on a desired impedance of transmission lines disposed on the substrate.

The first, second, and third dielectric layers are then laminated 940 to form board assembly 106 such that microstrip transmission line 108 is configured to be electromagnetically coupled to ground plane 112 and electromagnetically coupled to patch antenna element 110 through slot aperture 114. In certain embodiments, laminating 940 includes applying first adhesive film 612 between the first dielectric layer and the second dielectric layer, and applying a second adhesive film 612 between the second dielectric layer and the third dielectric layer. The dielectric layers are then aligned and pressed together. In embodiments having coupling element 120, adhesive film 612 is applied between the first and fourth dielectric layers, or first substrates 602 and second substrate 604. The four dielectric layers, including substrates 602, 604, 606, and 608, are laminated 940 to form board assembly 106, such that coupling element 120 is embedded in a layer between patch antenna element 110 and microstrip transmission line 108, and such that coupling element 120 is electromagnetically coupled between microstrip transmission line 108 and patch antenna element 110.

Method 900 includes attaching 950 proximal aperture 116 of waveguide 102 to top surface 610 of the first dielectric layer and enclosing patch antenna element 110. Waveguide 102 is configured to be electromagnetically coupled to patch antenna element 110. Dielectric lens 104 is then disposed 960 in distal aperture 118. Dielectric lens 104 may be deposited using additive methods, such as, for example, a printing process. In certain embodiments, disposing 960 dielectric lens 104 includes depositing a dielectric material, using a printing process, in a geometry corresponding to a geometry of distal aperture 118 of waveguide 102. For example, in alternative embodiments, waveguide 102 is a rectangular waveguide, and disposing dielectric lens 104 includes depositing the dielectric material in a pyramid shape. Further, in certain embodiments, where the geometry of the aperture of waveguide 102 includes a rectangular geometry, patch antenna element 110 includes a linear geometry corresponding to the rectangular geometry of waveguide 102. Similarly, where the geometry of the aperture of waveguide 102 includes a circular geometry, patch antenna element 110 includes a circular geometry corresponding to the circular geometry of waveguide 102. Dielectric lens 104 may be formed from any suitable dielectric material and, again, is selected along with its size and shape based on a desired impedance and corresponding to an operating frequency of RF antenna 100 and, for example, waveguide 102. The dielectric material is then deposited, for example, using a printing process, in a size and shape corresponding to the operating frequency of RF antenna 100, waveguide 102, and an emission pattern for RF antenna 100.

In certain embodiments, method 900 further includes disposing a second dielectric lens on patch antenna element 110 and extending into proximal aperture 116 of waveguide 102. Inclusion of the second dielectric lens improves the electromagnetic coupling of, for example, a microwave signal emitted from patch antenna element 110 into waveguide 102, and improves performance of the microstrip-to-waveguide transition with respect to return loss and insertion loss.

In certain embodiments, disposing dielectric lens 104 includes depositing a dielectric material, such as, for example, a thermoplastic polymer, polyactide (PLA), high impact polystyrene (HIPS), thermoplastic polyurethane (TPU), and thermoplastic elastomer (TPE).

The systems and methods described herein are not limited to the specific embodiments described herein, but rather, components of the systems and/or steps of the methods may be utilized independently and separately from other components and/or steps described herein.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

As used herein, an element or step recited in the singular and proceeded with the word "a" or "an" should be understood as not excluding plural elements or steps unless such exclusion is explicitly recited. Furthermore, references to "one embodiment" of the present disclosure or "an example embodiment" are not intended to be interpreted as excluding the existence of additional embodiments that also incorporate the recited features.

This written description uses examples to disclose various embodiments, which include the best mode, to enable any person skilled in the art to practice those embodiments, including making and using any devices or systems and performing any incorporated methods. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A radio frequency (RF) antenna, comprising:

a patch antenna element disposed on a top surface of a first substrate, the patch antenna element including a slot aperture;

a microstrip transmission line disposed between the first substrate and a second substrate, and configured to be electromagnetically coupled to the patch antenna element through the slot aperture;

a ground plane disposed on a third substrate and configured to be electromagnetically coupled to the microstrip transmission line;

a waveguide having a proximal aperture attached to the top surface and enclosing the patch antenna element, and a distal aperture opposite the proximal aperture, the waveguide configured to be electromagnetically coupled to the patch antenna element; and a dielectric lens disposed in the distal aperture of the waveguide.

2. The RF antenna of claim 1 further comprising a second dielectric lens disposed on the patch antenna element and extending into the proximal aperture of the waveguide.

3. The RF antenna of claim 1, wherein the dielectric lens has a size and shape corresponding to an operating frequency of the waveguide and an emission pattern for the RF antenna.

4. The RF antenna of claim 1, wherein the top surface comprises a first surface of the first substrate opposite a second surface of the first substrate, the second surface abutting the microstrip transmission line.

5. The RF antenna of claim 4, wherein the first substrate comprises a plurality of dielectric layers.

6. The RF antenna of claim 1, wherein the third substrate comprises a plurality of dielectric layers.

7. The RF antenna of claim 1, wherein the slot aperture includes a length, a width, and an angular orientation corresponding to an operating frequency of the waveguide.

8. The RF antenna of claim 1, wherein the dielectric lens includes a spherical body of dielectric material that extends at least partially into the waveguide from the distal aperture.

9. The RF antenna of claim 8, wherein the spherical body of dielectric material has a radius configured to impedance-match the waveguide and an operating frequency of the waveguide and maximize a gain of the RF antenna.

10. The RF antenna of claim 1 further comprising a tuning element disposed in a layer of the second substrate and configured to be electromagnetically coupled between the microstrip transmission line and the patch antenna element.

11. A method of fabricating a radio frequency (RF) antenna, comprising:

disposing a patch antenna element on a first dielectric layer, the patch antenna element including a slot aperture;

disposing a microstrip transmission line on a second dielectric layer;

disposing a ground plane on a third dielectric layer;

laminating at least the first dielectric layer, the second dielectric layer, and the third dielectric layer into a board assembly such that the microstrip transmission line is configured to be electromagnetically coupled to the ground plane and electromagnetically coupled to the patch antenna element through the slot aperture;

attaching a proximal aperture of a waveguide to a top surface of the first dielectric layer and enclosing the patch antenna element, the waveguide configured to be electromagnetically coupled to the patch antenna element; and disposing a dielectric lens in a distal aperture of the waveguide.

12. The method of claim 11 further comprising disposing a second dielectric lens on the patch antenna element and extending into the proximal aperture of the waveguide.

13. The method of claim 11, wherein disposing the dielectric lens comprises depositing a dielectric material, using a printing process, in a size and shape corresponding to an operating frequency of the waveguide and an emission pattern for the RF antenna.

14. The method of claim 13, wherein disposing the dielectric lens comprises depositing a dielectric material, using a printing process, in a geometry corresponding to a geometry of the distal aperture of the waveguide.

15. The method of claim 11, wherein disposing the dielectric lens comprises depositing a dielectric material selected from the group consisting of:

a thermoplastic polymer, polylactide (PLA), high impact polystyrene (HIPS), thermoplastic polyurethane (TPU), and thermoplastic elastomer (TPE).

16. The method of claim 11, wherein disposing the microstrip transmission line comprises depositing a conductive material onto the second dielectric layer, using a printing process, such that the microstrip transmission line has a width corresponding to a desired impedance value.

17. The method of claim 11, wherein disposing the patch antenna element comprises depositing a conductive material onto the first dielectric layer, using a printing process, such that the slot aperture includes a length, a width, and an angular orientation corresponding to an operating frequency of the waveguide, and such that the patch antenna element has a geometry corresponding to a geometry of the proximal aperture of the waveguide.

18. The method of claim 11 further comprising disposing a tuning element on a fourth dielectric layer, and wherein laminating includes laminating the fourth dielectric layer between the first dielectric layer and the second dielectric layer such that the tuning element is configured to be electromagnetically coupled between the microstrip transmission line and the patch antenna element.

19. The method of claim 11, wherein disposing the microstrip transmission line comprises:

depositing a layer of a conductive material onto the second dielectric layer; and etching the conductive material to form the microstrip transmission line having a width corresponding to a desired impedance value.

20. The method of claim 11, wherein laminating comprises:

applying first adhesive film between the first dielectric layer and the second dielectric layer; and applying a second adhesive film between the second dielectric layer and the third dielectric layer.

* * * * *